United States Patent [19]

Heinlein et al.

[11] 4,093,417

[45] June 6, 1978

[54] METHOD FOR PROCESSING TEXTILE MATERIAL

[76] Inventors: Karl Hans Heinlein, Alte Bahnaofstrasse 33; Joachim Busch, Poststrasse 6, both of D-649 Schluechtern, Germany

[21] Appl. No.: 600,049

[22] Filed: Jul. 29, 1975

[30] Foreign Application Priority Data

| | | |
|---|---|---|
| Jun. 1, 1974 | Germany | 2437173 |
| Mar. 4, 1975 | Germany | 2509381 |

[51] Int. Cl.[2] ..... B08B 3/00

[52] U.S. Cl. ..... 8/137; 252/8.6; 252/100

[58] Field of Search ..... 8/137, 139; 252/8.6, 252/100, 142

[56] References Cited

U.S. PATENT DOCUMENTS

| | | | |
|---|---|---|---|
| 3,650,672 | 3/1972 | Swayn | 8/137 |
| 3,915,633 | 10/1975 | Ramachandran | 8/137 |
| 3,950,277 | 4/1976 | Stewart et al. | 8/137 |
| 3,969,282 | 7/1976 | Kappler et al. | 252/100 |

OTHER PUBLICATIONS

Rose, The Cond. Chem. Dict. 7th Ed., 1966, Reinhold Publ. Co., p. 857.

Matthews, J. M., Matthews' Textile Fibers, John Wiley & Sons, N.Y., 1924, pp. 272–273.

Trotman, S. R. et al., The Bleaching, Dyeing and Chemical Technology of Textiles Fibers, Charles Griffin & Co. Ltd., London, 1946, pp. 300–303.

*Primary Examiner*—William E. Schulz

*Attorney, Agent, or Firm*—Whittemore, Hulbert & Belknap

[57] ABSTRACT

A method for washing textile material including first prewashing the textile material in an acid wash solution having a pH below 6.5 whereby incrustations remaining on the textile material formed in a previous main wash cycle are dissolved in the prewash cycle and then washing the material in a main wash cycle with a phosphate-free alkaline liquor whereby incrustations form on the textile material for removal during a second prewash cycle. The prewashing may be accomplished for 1–3 minutes at a temperature of 40° C. while the main washing may be accomplished for the usual time at boiling temperature.

20 Claims, No Drawings

METHOD FOR PROCESSING TEXTILE MATERIAL

The invention concerns a method for processing textile material, such as the processing of fibers, and particularly a method for washing fabrics, commercial or household linen etc. with at least one prewash and one main wash cycle, as well as with one or more rinse cycles, where the material is treated in the wash cycle with an alkaline solution.

In commercial laundries as well as in households fabrics and linen are usually washed in washing machines according to a method that can be subdivided at least into one pre-wash cycle, one main wash cycle and one or more rinse cycles. The prewash cycle is usually effected at relatively low temperatures in view of stains consisting of protein compounds. The temperature in the main wash cycle depends on the type of textile material.

Modern machine detergents contain up to 50% and more phosphate compounds. These have the function of softening the wash water thoroughly, preventing the formation of non-cleaning, smearing lime soap, as well as the precipitation of incrustations and dissolving existing incrustations or those forming on the textile material. These incrustations of the textile material formed by chemical reactions have a considerable fiber-damaging effect. Increasing incrustation of the textile material can be demonstrated by an increase of the ash content of the textile material with increasing number of wash cycles through which the material must pass. If a test fabric, which has an ash content of 0.56% in the unwashed state, is washed with a good phosphate-containing household detergent with water of 20 deg. German hardness, the ash content increases to 0.1 to 0.2% after 25 and 50 washings resp. If a phosphate-free household detergent is used instead, the ash content is 6 to 13% after 25 and 50 washings resp.

The raw materials for the preparation of the phosphate compounds must be imported, however, to a great extent and are very expensive. It was found in particular that the phosphates remaining in the waste water from the washing process lead to overfertilization of the surface waters and to a great increase of the organic substances which deprive the water to a great extent of oxygen.

It has therefore been tried for a long time to replace the phosphates in modern detergents. To this end have been suggested organic sequestering agents, which could not assert themselves, however, at least not in Europe. They lead in addition to an increase of the organic substances and of the nitrogen content of the sewage. It has been suggested to use citric acid or tartaric acid to dissolve the incrustations. But the starting materials are likewise too expensive, and the load of the sewage with organic substances is too high.

In general we can start from the consideration that the objective in all current washing methods was to dissolve all incrustations formed and to prevent the precipitation and the deposit of these incrustations on the textile material. These efforts led to relatively complicated compositions of the detergents used. The result is that it is not possible to control the reactions taking place during the washing. Nevertheless it was not possible to abandon this path because the surface active substances, which are highly effective in soft water, lose their effectiveness rapidly with increasing water hardness. Increasing incrustation of the textile material by frequent washing leads not only to brittling of the textile material, but has finally the result that the textile material has a sort of filter effect and retains in the fabric the soil contained in the liquor. As mentioned above, the incrustation and brittling lead finally to a mechanical damage of the fibers during the washing. The object of the present invention, on the other hand, is to improve a washing method of the above described type so that the cleaning action of the detergent used is not impaired even when washing with hard water, that the number of chemical processes and reactions taking place is reduced and therefore easier to control, and that the load of the sewage with fertilizing or oxygen-consuming substances is reduced, thus permitting the use of detergents which do not depend on expensive and/or imported raw material.

This problem is solved according to the invention in this way that the laundry is first washed in an acid wash liquor with a prewash detergent which also contains surface-active substances which are also effective in the acid range, and that incrustations are deliberately produced in the main wash cycle on the material to be treated, whose chemical composition is such that they remain on the textile material up to the next wash etc., while they are soluble in the acid wash liquor of the next prewash cycle. The washing process is thus so controlled that not all incrustations are dissolved or prevented from precipitating, as heretofore, but that incrustations are deliberately produced on the textile material in the main wash cycle, but only those which can be reliably dissolved in the next pre-wash cycle, while they are applied again in the main wash cycle of the next wash in the same manner on the textile material. The incrustations formed in the main wash cycle do not lead to a marked increase of the ash content. Such an increase of the ash content can only appear to a considerable extent if the incrustations can increase in several following washing processes, as it can be the case if phosphate-free household detergents are used. In the new method, only the incrustation formed in the last wash is on the washed textile material and is reliably dissolved again in the prewash cycle of the next wash.

The nature and chemical composition of the incrustations formed deliberately in the main wash cycle of the new method are determined in advance so that these incrustations can be dissolved deliberately and reliably by the adjustment of the next pre-wash cycle. The selection of the detergent in the main wash cycle ensure that only the desired predetermined incrustations are formed and the formation of difficultly soluble or insoluble incrustations is impossible.

The new method makes use of the fact that the dirt substances are deposited during wear at least partly on the incrustations formed deliberately on the textile material during the last wash. By dissolving these incrustations in the next prewash cycle, a part of these dirt substances are thus automatically removed from the textile material.

Practice has shown that with this method we can also accept the fact that difficultly soluble substances are also obtained in the main wash cycle, which do not interfere, however, if carbonates (soda) are contained in a sufficient amount in the phosphate liquor of the main wash cycle. Practice has also shown that, due to the fact that the carbonates are precipitated first in the main wash cycle, the subsequently precipitated difficultly soluble substances are deposited on the carbonate incrustation, so that their removal in the next prewash cycle presents no difficulties.

It is thus possible to use in the alkaline main detergent to a large extent cheap wash alkalies, like waterglass or sodium metasilicate, without an increase in the ash content. Likewise, the customary soil carries carboxymethyl-cellulose or carboxymethyl starch can also be used.

Particularly simple is the new method if care is taken during the main wash cycle that the incrustations formed on the textile material consist substantially of carbonates, particularly alkaline starch carbonates. The solid substance of the main detergent consists therefore preferably of water-soluble carbonates, preferably soda.

The main detergent contains preferably non-ionic or anionic substances, also soap, if desired.

In addition to the surface-active substances and the conventional additives, the main detergent contains preferably primarily alkali carbonates, particularly soap or ammonium carbonate.

In the prewash cycle are used surface-active substances which are also or only effective in acid solution. the pH-value of the acid prewash solution is preferably below 6.5 and can attain values of 2 or less.

The surface-active substances that can also or only be used in the acid range need not be imported and are cheap. Even waste products from other chemical processes can be used for this purpose. Particularly advantageous as prewash detergents are sulfonic acids. Highly suitable are, for example, dodecyl benzene sulfonic acid, paraffin or olefin sulfonic acid or toluene-sulfonic acid. If certain precautions are taken, lignin sulfonic acid can also be used as a prewash detergent. It is obtained in large amounts in the spent liquor from the decomposition of sulfite cellulose.

But the prewash detergent can also contain carboxylic acids. The standardization of the desired pH-value under 6.5 can also be effected simply by adding a mineral acid to the prewash solution.

It was found surprisingly that the acid standardization of the prewash solution does not lead to disadvantages or damages in many textile materials. It is assumed that this is due, on the one hand, to the fact that relatively low temperatures up to about 40 deg. are used in the prewash cycle, and on the other hand, to the short action of the prewash liquor. Certainly the fact that the acid of the prewash solution is substantially used up during the dissolution of the incrustations deliberately formed on the textile material also plays a role. By adapting the degree of acidity of the prewash solution to the type and amount of the incrustations and to the amount of the textile material, it is possible to control the chemical processes in a simpler manner.

Defoaming is not necessary in the new method which improves the dissolving capacity and further reduces the sewage problem.

The prewash detergent can also be liquid.

It was found advantageous to adjust the prewash detergents with regard to the pH-value to the character of the incrustation by starting from the thumb rule that about 50 ml of the liquid prewash detergents are required per kg of the textile material to be treated, and about 10 ml prewash detergent per degree of hardness of the water used. From the degree of hardness and the amount of the textile material even a layman can thus easily determine the total amount of prewash detergent used.

Practice has shown that one prewash cycle is enough in the new method. If a stronger treatment should be necessary, the prewash cycle can be followed by an intermediate wash cycle, or by two main wash cycles, using in each cycle a neutral or alkaline wash solution.

Commercial laundries usually work without an intermediate wash cycle between the prewash and the main wash cycle. Since a part of the prewash solution is still in the textile material in this method when the main wash cycle starts, the surface-active substances of the preliminary wash can partly be used again in the alkaline range.

It results from the foregoing rule of thumb that for water of less hardness it is only necessary to reduce the amount of prewash detergent. But care must be taken that there are incrustations or soilings from wear or use, which result as a rule in hardening of the water.

The new method works completely without phosphate compounds. The detergents for the prewash cycle and main wash cycle contain only cheap surface-active substances which are readily available at home. The composition of the detergents is simple, so that the chemical reactions to be expected can be easily overlooked. The sewage originating from the washing process is practically free of substances that produce overfertilization or increasing the content of organic substances. The treatment of the sewage requires less neutralizing agents than heretofore to transform it into a state in which an effective decomposition of the impurities take place. The reduction is particularly due to the fact that the waste water from the alkaline main wash cycle is already partly neutralized by the acid of the waste water from the prewash cycle.

With the prewash and main wash cycle effected in the same washing drum, the latter is kept completely bright.

In the new method can also be used bleaching agents without any difficulties. The customary bleaching agents, like sodium perborate, can be used. Of particular advantage is the addition of sodium percarbonate to the detergent of the main wash cycle. This bleaching agent enhances the formation of readily soluble carbonate incrustations on the material to be treated.

The customary brighteners for the various types of fibers, as well as perfumes can be used. It is also possible to add softeners, if necessary, in the rinse cycle without impairing the washing process according to the invention.

The new washing process makes it unnecessary in most cases to provide special softening devices for the water, which also avoids the salt increase of the water as a result of the softening process.

The handling of the acid prewash detergent presents no difficulties in practice not even when used in private households. It is possible to provide in the washing machines automatic dosing devices for the liquid prewash detergent, as it is customary, for example, in dishwashing machines for liquid clear rinses, which are filled as a whole, into a corresponding dosing tank for many rinse cycles. But the acid prewash detergent can also be used in solid form.

According to the above described method, the waste water would be acid, which could lead to corrosion in the sewer pipes. This can be avoided, while increasing considerably the washing effect, by using the prewash acid detergent only in the first 1–3 minutes of the prewash cycle and then adding the alkaline main detergent to the prewash liquor. The prewash cycle is then normally completed alkaline at 40° C. A dissolution time of 1–3 minutes is absolutely sufficient for a correspondingly low pH-value (2–5). This also greatly reduces the denaturation of proteins. The primarily alkaline portion of the prewash solution, in which enzymes can also be used, considerably enhances the soil release.

In commercial laundries it was found of advantage to use a preliminary bath containing the prewash solution into which the textile material is dipped in charges for saturation or wetting, bringing the liquid of the preliminary bath to the original level and to the original composition merely by adding the substances forming the prewash solution individually or in mixture. After the textile material has been dipped into the preliminary bath, it is brought directly into the first main wash cycle.

In commercial laundries the washing time determines the profitability. Here it may be of advantage to wet the dirty wash at first neutral or even slightly alkaline in order to saturate the fibers and protein stains. The carbonate incrustations on the fiber surface are subsequently reliably dissolved in a short (1 – 3 minutes) acid bath.

When using a household washing machine, the textile material is preferably brought first together with the acid prewash solution in a low ratio of textile material to liquid, for a short time only, after which, again without removing first the prewash solution, the liquid portion is filled up in the washing drum by adding the alkaline main detergent until the degree of filling customary for the machine has been achieved. With this filling is then performed a main wash cycle at a temperature up to 40° C, and then the liquid is removed for the first time from the machine.

This way the acid liquid of the prewash cycle does not get into the waste sewage either in commercial or in household washing machines. Consequently this prewash solution can have no effect on the sewage pipe or on the sewage. The acid content of the prewash liquid is more than compensated by the addition of the alkaline main wash solution, so that the wash liquor is no longer acid when it is removed from the first main wash cycle.

This procedure naturally simplifies the method considerably since there is no necessity to remove the prewash solution, and the latter can be disregarded.

Another great advantage is that the surface-active substances contained in the prewash solution, which are effective in the acid range, practically always also have a good washing effect or in the first main wash cycle can be utilized until they are completely exhausted. This means that the duration of the acid wetting process can be kept very short, so that a prewash cycle of 1 to 3 minutes is fully sufficient in a household washing machine for wetting the textile material, with the acid prewash solution.

The pH-value of the prewash solution is here about 2.

Particularly advantageous is the acidification of the prewash solution with a mineral acid, e.g. diluted sulfuric acid, or the solution of a salt of such an acid. In commercial laundries the diluted acid can be added to the preliminary bath together with the other liquid portions of the prewash solution individually or in mixture to adjust the liquid level and the composition of the liquid solution. Suitable for a premix, while maintaining the fluidity, are surface-active substances of non-ionic surfactants, particularly fatty alcohol-hydroxyethylates. These are readily soluble in diluted sulfuric acid. But alkylaryl sulfonic acid or its sodium salt or others can also be used.

The use of acids for the acidification of the prewash solution has no harmful effect on the textile material. Tests under the conditions indicated in the older application have shown that the ash content never rose over 0.2% in over 150 washings on one and the same textile material, even when using a sulfuric acid solution and when the raw water had a hardness of 20° German hardness scale. The textile material was ironed additionally after each washing.

Though a liquid detergent can also be used in household washing machines, powdered detergents are preferred.

Particularly suitable for the acidification of the prewash solution, especially in household washing machines, is sodium bisulfate ($NaHSO_4$). It can be added to a powdered detergent in a mixture of up to 25% surface-active substances, for example (surfactants), and up to 10% silica gel. Since the silica gel is not water-soluble, however, it raises problems of sewage pollution.

The sodium bisulfate is therefore preferably mixed with a small amount of bicarbonate or soda or with a mixture of these substances. Generally alkali carbonates can be used.

The acid prewash detergent may contain an alkaline solution in microcapsulated form.
an alkaline solution in microcapsulated form.

It is also possible to mix the sodium bisulfate with 5% percarbonate, for example. Instead of percarbonate can also be used perborate. The powder obtained has the additional advantage of oxygen bleaching during the saturation or wetting process. The disadvantage is that the commercial optical brighteners normally show a reversible yellowing in an acid environment, which leads, however, in the presence of percarbonate to a transformation into a yellow pigment whose coloration is no longer reversible.

For this reason a mixture of sodium bisulfate with soda or with bicarbonate or a mixture of both substances is preferred. With soda, a portion of 4% by weight is sufficient. With a mixture of soda and bicarbonate, a portion of 6.3% by weight in the total amount of solids has proved advantageous. To the prewash detergent can also be added up to 15%, preferably up to 12% surface-active substances (surfactants). In the preferred mixture these additional surface-active substances may be completely missing, however. The sodium bisulfate can vary between 50 and 95% by weight, preferably it is up to about 80% by weight.

Sodium bisulfate is extremely cheap, as known, it leads to an easy to handle fluid powder and has proven in tests extremely suitable as a household prewash detergent according to the invention. The low costs of sodium bisulfate, which is obtained technically in large amounts, permit the use of enzymes in the prewash detergent without markedly increasing the costs of the latter.

The use of these enzymes may become necessary in some cases, since the protein compounds tend to denature in acid solution and are then difficult to remove.

The attack of protein compounds with enzymes is also known in detergents. The known enzymes have been used, however, heretofore only in alkaline media and have been grown for such alkaline media. There are however, also enzymes which are effective in the acid range, as tests have shown. These are pepsin and trypsin. The latter is a known protein-digesting ferment of the pancreas. Trypsin is also known in prewash detergents. If this ferment is used in the prewash detergent according to the invention, it is at first effective in the acid prewash solution, even at normal tap water temperature. It prevents thus to a great extent denaturation of the protein compounds in this acid liquid. Additions of 0.1 to 0.5% by weight tripsin have proved completely sufficient for the effective prevention of denaturation of the protein compounds in the prewash cycle.

But the addition of trypsin, which is very expensive today, can also be foregone and instead 0.2–1% of a much cheaper proteolytic ferment which is effective in the alkaline range can be added to the main detergent, which then degrades the proteins during the remaining alkaline prewash cycle and during the heating of the main wash solution.

For household linen, the washing machine can be run first with half the liquid filling to wet the textile material with the acid wash liquor, that is, the necessary amount of prewash detergent is charged into the washing drum with half the usual amount of liquid. After a wash treatment of 2–3 minutes, the main detergent is introduced together with additional water which can have any hardness, and a full wash cycle up to 40° C is performed. The wash liquor of the first main wash cycle is the first wash liquid flowing from the machine into the drain. It has normally a low alkaline range, since the acid of the wetting cycle is fully neutralized. In the last main wash cycle, the incrustations containing the carbonates are applied on the textile material, which are completely released during the wetting or prewash cycle of the next wash.

In addition to the usual hardness formers, both the soaking and the wash water can contain a few percent soluble alkane salts, if the use of salt-sensitive surfactants (soaps) is foregone. Consequently it is also possible with this method to wash with sea water, and to use only for the last rinse cycles unsoftened fresh water to rinse out the salts. If sea water is used, the ash values may be by several tenths of a percent higher. But they never exceed 1%, nor do they interfere in any way.

EXAMPLES

In the examples 1 – 4, 2.5 kg greatly soiled underwear of a so-called standard textile fabric were washed in a household washing machine with hard water of 22° German hardness. The test fabric had in the unwashed state an ash content of 0.56%. After the number of washings indicated below, a strip of the test fabric was torn off and sent to the laboratory. The prewashing was effected at 40° C, the main washing at boiling temperature. The test fabric was first washed under the indicated conditions with a good phosphate-containing ordinary household detergent. The ash contents after 25 and 50 washings were then 0.1–0.2%. This indicates that incrustations of the text fabric could be avoided by the phosphate content of the detergent. An identical test fabric was washed in addition with a phosphate-free ordinary household detergent. The ash contents after 25 and 50 washings were 6–13%. This makes it clear that incrustations were formed increasingly in the test fabric.

EXAMPLE 1

As a prewash detergent we used 1 part toluene sulfonic acid per 3 parts water. 150 ml of this dilution were used for the prewash cycle under the above indicated conditions. The pH-value of the spent liquor was 1.6.

For the main wash cycle we used a phosphate-free detergent of the following composition:

18% sodium percarbonate
6% alkylphenol hydroxyoxethylate (9 moles ethylene oxide)
1.5% alkylphenol hydroxyoxethylate (5 moles ethylene oxide)
1.5% alkylphenol hydroxyoxethylate (3 moles ethylene oxide)
0.3% of a commercial optical brightener for cotton
0.003 of a commercial optical brightener for polyester and polyamide
0.25% perfume
balance soda 52 g of this detergent were used for the main wash cycle. The pH-value of the spent liquor was 7.6.

The laboratory test showed that the test fabric had the following ash content after the indicated number of washings:

| | |
|---|---|
| 5 washings | 0.25% |
| 10 washings | 0.17% |
| 25 washings | 0.17% |

EXAMPLE 2

As a prewash detergent we used one part lignin sulfonic acid (45%) per one part water. 250 ml. of this dilution were used for the prewash cycle (spent liquor pH = 4.0).

As a main detergent we used the detergent of Example 1 in the same amount (pH = spent liquor: 9.8).

The ash content of the test strip washed this way was after the indicated number of washings:

| | |
|---|---|
| 5 washings | 0.45% |
| 10 washings | 0.43% |
| 15 washings | 0.41% |

EXAMPLE 3

As a prewash detergent we used one part dodecyl benzene sulfonic acid per 3 parts water. 300 ml of this dilution were used for the prewash cycle (spent liquor pH = 3.5).

For the main wash cycle we used a detergent of the following composition:

5% alkyl phenol hydroxyethylate (9 moles ethylene oxide)
1.5% alkyl phenol hydroxyethylate (5 moles ethylene oxide)
1.5% alkyl phenol hydroxyethylate (3 moles ethylene oxide)
0.3% optical brightener for cotton (commercial)
0.03% optical brightener for polyester and polyamide (commercial)
0.3% perfume
24.4% sodium perborate
0.4% magnesium silicate
balance soda.

52 g of this detergent were used in the main wash cycle (spent liquor pH = 9.5).

The test fabric washed this way had the following ash content after the indicated number of washings:

| | |
|---|---|
| 5 washings | 0.52% |
| 10 washings | 0.50% |
| 25 washings | 0.46% |
| 50 washings | 0.48% |

In the Examples 1 and 3 we obtained perfectly clean and well-bleached laundry. Example 2 yielded a slight discoloration, a sort of yellowing. Damages of the treated fibers could not be found. PH-values under 2 impaired neither the washing result nor the textile material.

The new method can be used successfully not only for underwear, household and commercial linen, but also in the treatment of raw fibers for various purposes.

We also made tests with a prewashed detergent where the acid standardization of the prewash solution was effected by the addition of mineral acid.

EXAMPLE 4

Prewash detergent:

1 part dodecyl benzine sulfonic acid
2 parts amidosulfonic acid
7 parts water of which 312 ml of each were used per prewash cycle (spent liquor pH = 2.1).

Main detergent:

5750 g soda
24 g optical brightener (cotton)
2.4 g optical brightener (polyamide, polyester)
480 g fatty alcohol hydroxyethylate
120 g nonylphenol
1450 g sodium perborate
20 g perfume Spent liquor, pH = 8.9).

| | | |
|---|---|---|
| Ash content: | 5 washings | 0.24% |
| | 10 washings | 0.28% |
| | 25 washings | 0.27% |
| | 50 washings | 0.25% |

EXAMPLE 5

For washing household linen we proceeded as follows:

First we used a prewash detergent in a household washing machine with about half the liquid filling, which has the following composition:

12% by weight surfactive substances
81% by weight sodium bisulfate
2% by weight soda
4.5% by weight sodium bicarbonate
0.5% by weight trypsin The amount of prewash detergent used was about 30 g per kg wash.

After 3 minutes, 22 g per kg wash of a main detergent were added.

After a normal wash cycle at a temperature of up to 40° C, the washing is effected in a main wash cycle at boiling temperature with 25 g per kg wash.

In both cases the main detergent had the following composition:

10% by weight surface-active substances
0.2% by weight optical brightener
49% by weight soda
0.3% by weight carboxymethyl cellulose
21% by weight sodium perborate
16% by weight soap
3% by weight potassium metasilicate
0.3% by weight magnesium silicate
0.2% by weight perfume A wash of normal fabric had an ash content of 0.2% after 50 washings.

EXAMPLE 6

For washing in a commercial laundry we used a prewash detergent of the following composition per kg wash:

2.3 g dodecyl benzene sulfonic acid
4.5 g sulfuric acid (conc.)
0.75% g fatty alcohol hydroxyethylate For the following wash cycle we used:

22 g phosphate - free detergent powder per kg wash

For bleaching we used 2 g bleaching liquor per kg wash. Composition of the main detergent is similar to that of the main detergent of Example 1 but without perborate, perfume and carboxymethyl cellulose.

After 125 washings, the ash content of the standard fabric was 0.15%.

EXAMPLE 7

For washing in a household washing machine we prepared "sea water" by stirring 27.2 g common salt
1.3 g gypsum
5.5 g magnesium salts in each liter hard water of 20° German hardness.

For the prewash cycle we used a prewash detergent similar to that in Example 1, but without trypsin.

The main detergent consisted of:

8% by weight surface-active substances
73% by weight soda
0.33% by weight optical brightener
18.67% by weight sodium perborate The amount used is the same as in Example 1.

At the end of the washing cycle, we rinsed with hard water of 20° German hardness. The ash content after 15 washings was 0.12%.

We claim:

1. Method for washing textile material consisting of at least one prewash and main wash cycle and one or more rinse cycles, where a phosphate-free alkaline wash liquor is used in the main wash cycle, characterized in that a prewash detergent with surface-active substances acting in the acid range is used in acid wash solution in the prewash cycle, and that carbonate incrustations whose composition is such that they dissolve in the acid wash solution of the prewash cycle remaining on the textile material to be treated are formed in the main wash cycle.

2. Method according to claim 1, characterized in that the textile material is treated in the prewash cycle with a sulfonic acid.

3. Method according to claim 2, characterized in that a sulfonic acid from the group: dodecyl benzene sulfonic acid, paraffin sulfonic acid, olefin sulfonic acid, toluene sulfonic acid, and lignin sulfonic acid is used for the prewash solution.

4. Method according to claim 1, characterized in that the textile material is treated in a prewash cycle with a carboxylic acid.

5. Method according to claim 1, characterized in that the pH-value of the prewash solution is standardized by means of a mineral acid to a value below 6.5.

6. Method according to claim 1, characterized in that detergents are used in the main wash cycle which contain no substances forming difficulty soluble alkaline earth salts in the textile material except carbonates, and contain only surface-active substances which are also clearly soluble in acid solution.

7. Method according to claim 1, characterized in that the textile material is only saturated in the acid prewash solution and combined in the saturated state, without removing any prewash solution, with the alkaline liquor of a main wash cycle or the solid main detergent.

8. Method according to claim 7, characterized in that the textile material is dipped in charges into a preliminary bath containing the prewash solution, and that the preliminary bath is brought to the starting composition by adding the substances forming the prewash solution individually or in mixture after each or after a predetermined number of charges.

9. Method according to claim 1, characterized in that a detergent free of phosphate compounds and organic sequestrants is used in the main wash cycle, which forms on the textile material incrustations in the form of alkaline earth carbonates.

10. A method according to claim 9, characterized in that only surface-active non-ionic and/or anionic substances are used in the main wash cycle, which substances are either themselves or whose alkaline earth salts are clearly water-soluble below about pH = 5.

11. Method according to claim 1, characterized in that a detergent is used in the main wash cycle which contains, in addition to the surface-active substances and customary additives, like optical brighteners and bleaching agents, mainly ammonium and/or alkali carbonate, particularly soda.

12. Method according to claim 7, using a household washing machine, characterized in that the textile material is first combined with the prewash solution in a low ratio of textile material/liquid for 1 to 10 minutes, preferably 1 to 3 minutes, after which, without removing liquid, the liquid portion is brought to the normal value for the machine by adding alkaline main wash liquor or solid main detergent, and a main wash cycle is performed at a temperature of up to 40° C, after which wash liquid is removed for the first time.

13. Method according to claim 7, characterized in that a solution of water, an acid of one of the mineral or non-complex forming organic types and a surface-active substance effective in the acid range is maintained in the preliminary bath at a pH-value between 1.0 and 6.

14. Method according to claim 13, characterized in that non-ionic fatty alcohol hydroxy ethylates or alkylaryl sulfonic acid or sodium salt are used as surface-active substances.

15. Method according to claim 14, characterized in that a powdered prewash detergent is used which consists of 0 to about 15% by weight surfactants, 2 to 20% by weight of at least one of soda, bicarbonate and a mixture of both and 50 to 95% sodium bisulfate.

16. Method according to claim 7 characterized in that the prewash detergent already contains protein disintegrating enzymes effective in acid solution, in the acid solution.

17. Method according to claim 7, characterized in that the alkaline main detergent contains proteolytic ferments which are effective in the alkaline range.

18. Method according to claim 7, characterized in that sea water is used for at least one of prewashing, washing and the first rinse cycle and wherein at least the last rinse cycle is with fresh water.

19. Method according to claim 7, characterized in that the acid prewash detergent contains alkaline solution in microcapsuled form.

20. The method according to claim 7, characterized in that a solution of water, an acid bath of one of the mineral or non-complex forming organic types and a surface-active substance effective in the acid range is maintained in the preliminary bath at a pH-value of approximately 2.

* * * * *